United States Patent [19]

Bongen et al.

[11] Patent Number: 4,894,252

[45] Date of Patent: Jan. 16, 1990

[54] COATING MATERIAL ORIFICE CLOGGING INDICATION METHOD AND APPARATUS

[75] Inventors: Francis W. Bongen, Indianapolis; Richard D. Combs, Westfield; James C. Foster, Danville; Donald G. Godfrey, Indianapolis, all of Ind.

[73] Assignee: Ransburg Corporation, Indianapolis, Ind.

[21] Appl. No.: 277,971

[22] Filed: Nov. 30, 1988

[51] Int. Cl.[4] ..... B05D 1/02; B05C 11/10

[52] U.S. Cl. ..... 427/8; 118/677; 118/314; 118/679; 118/697; 118/712; 427/421

[58] Field of Search ..... 427/8, 421; 118/677, 118/679, 697, 712, 302, 313, 314; 239/76, 104, 106, 124, 126

[56] References Cited

FOREIGN PATENT DOCUMENTS 57-20361 2/1982 Japan ..... 239/104

*Primary Examiner*—Evan Lawrence

*Attorney, Agent, or Firm*—Barnes & Thornburg

[57] ABSTRACT

A method of coating articles comprises providing a plurality of coating dispensing devices at each station in a coating material application line, each device being connected to a common source of coating material. Coating material is dispensed fron only one device while measuring the flow rate of coating material therethrough. When the measured flow rate falls below a predetermined threshold, flow through the device is automatically terminated and switched to another device. Apparatus for practicing the method includes a plurality of dispensing devices connected to a common coating source through respective flow rate sensors. A programmable logic control station connected to the sensors and the devices is used to control the operation of the dispensing devices.

4 Claims, 2 Drawing Sheets

COATING MATERIAL ORIFICE CLOGGING INDICATION METHOD AND APPARATUS

This invention relates to methods and apparatus for the application of coating materials to articles to be coated by such materials. It finds particular utility in situations in which articles are conveyed serially before a more or less stationary installation of coating material dispensing devices. However, it may be useful in other applications as well.

One of the problems associated with coating material application systems, both manual and automatic, is that the dispensing devices of such systems can become clogged with coating material. Such clogging, in a conveyorized- or "assembly line"-type coating material application system, can result in substantial rework of articles, the coating applied to which is unacceptable due to the clogging of the coating dispensing devices. Such rework, of course, adds to the finished cost of the articles, due both to having to recoat the articles requiring rework, and to the additional facilities that may be required to accommodate such rework.

It is an object of the invention to reduce the likelihood that clogging of a coating material dispensing device will necessitate correction of the coatings applied to articles coated during intervals during which a dispensing device is clogged.

According to one aspect of the invention, a method of coating articles with a coating material on a coating material application line includes the steps of providing a plurality of coating material dispensing devices at each station from which coating material is to be dispensed, only one of the dispensing devices being operative at any time, the remaining being redundant. A source of coating material is coupled to each of the devices at the station through a respective flow rate sensor. A selected one of the coating dispensing devices is triggered to dispense coating material during intervals during which coating material is to be dispensed from the station onto the articles to be coated, and the flow of coating material through the flow rate sensor associated with that selected one of the dispensing devices is monitored. If the flow of coating material through the flow rate sensor associated with that selected one of the dispensing devices falls below a predetermined threshold, that selected dispensing device is triggered to stop dispensing coating material and another selected one of the dispensing devices at that station is triggered to dispense coating material.

Illustratively, articles are to be coated only during certain intervals. A selected coating material dispensing device is to be triggered to dispense coating material only during such intervals. The method further comprises the step of inhibiting the dispensing of coating material from all of the dispensing devices at a station except during such intervals.

According to another aspect of the invention, apparatus for coating articles with a coating material on a coating material application line includes one or more stations from which coating material is to be dispensed onto articles on the coating material application line. A plurality of coating material dispensing devices are provided at each station from which coating material is to be dispensed. A source of coating material is provided, as are means for coupling each of the dispensing devices at each station to the source of coating material. The coupling means includes a respective flow rate sensor for each dispensing device. Means are provided for triggering a selected one of the coating material dispensing devices to terminate dispensing of coating material and another selected one of the coating material dispensing devices to begin dispensing of coating material when the rate of flow of coating material through the flow rate sensor associated with the selected one of the coating material dispensing devices drops below a predetermined threshold. Means are provided for coupling the flow rate sensors to the triggering means.

According to this aspect of the invention, articles are to be coated only during certain intervals. A selected coating material dispensing device is to be triggered to dispense coating material only during such intervals. The apparatus further includes means for inhibiting all of the coating material dispensing devices at the station except during such intervals.

The invention may best be understood by referring to the following description and accompanying drawings which illustrate the invention. In the drawings.

Figure 1:
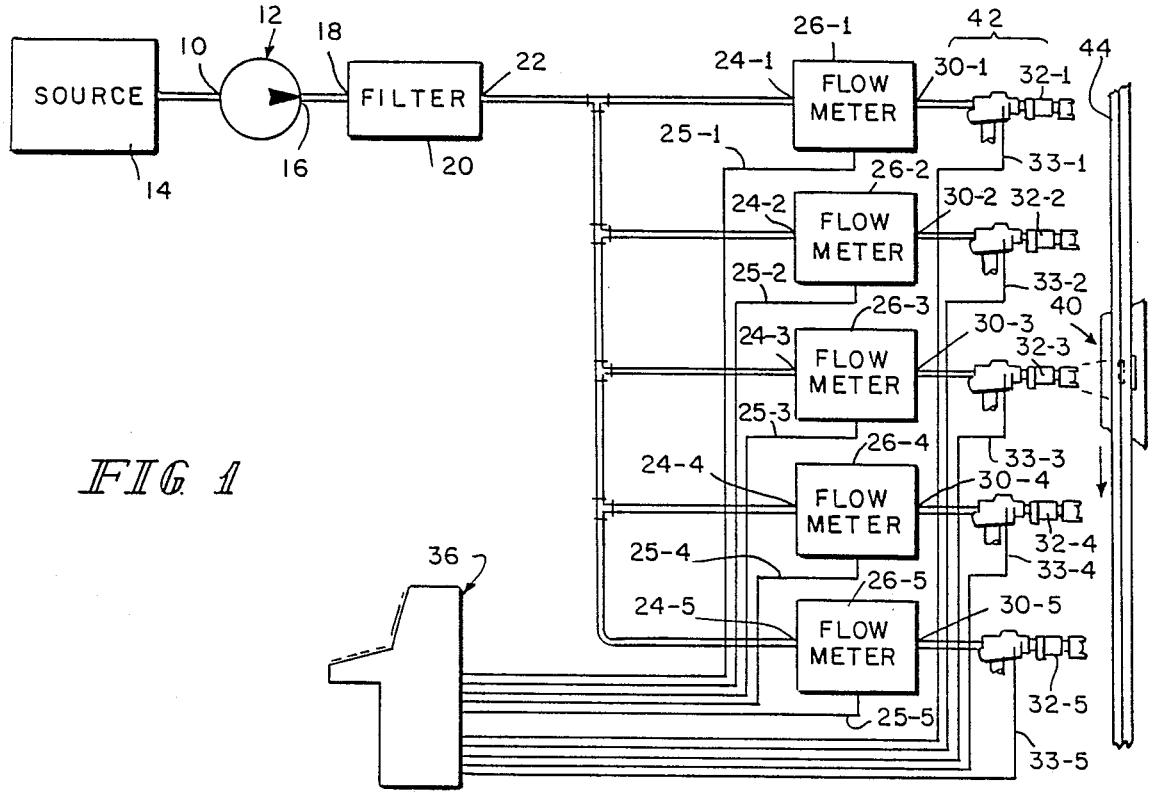
FIG. 1 illustrates a partly block and partly schematic diagram of a system constructed according to the invention for practicing the method of the invention.

Referring to FIG. 1, the input port 10 of a pump 12, such as the model 701 SPEC-686 single stroke booster pump available from Ransburg Gema, P.O. Box 88220, Indianapolis, Indiana, 46208-0511, is coupled to a source 14 of any suitable coating material, such as Anti-Chip TPX 1520, available from PPG Industries, Inc., Automotive Products, 2155 West Big Beaver, Troy, Michigan, 48084. The output port 16 of pump 12 is coupled to the input port 18 of a suitable filter 20. Here filter 20 is a 100 mesh filter. The output port 22 of filter 20 is coupled to the input ports 24-1 to 24-5 of five identical fluid flow rate sensors 26-1 to 26-5, such as the model 701-HED-688-202 MOD flow rate sensor available from Ransburg Gema. The output ports 30-1 to 30-5 of flow rate sensors 26-1 to 26-5, respectively, are coupled to the input ports of respective coating material dispensing devices 32-1 to 32-5. Devices 32-1 to 32-5 illustratively are model 61 automatic spray guns available from Binks Manufacturing Company, 9201 West Belmont Avenue, Franklin Park, Ill., 60131.

The electrical terminals of each flow rate sensor 26-1 to 26-5 are coupled by lines 25-1 to 25-5, respectively, to respective terminals of a programmable logic control station (PLC) 36 which provides power to the flow rate sensors 26-1 to 26-5, and senses the electrical output signals from sensors 26-1 to 26-5 which indicate the flow rates through the sensors 26-1 to 26-5 and their respective guns 32-1 to 32-5. PLC 36 illustratively is Ransburg Gema Model 26419-16 manual adjust station. Of course, according to the invention, only one of guns 32-1 to 32-5 will be dispensing coating material at any given time, so the station 36 in this embodiment of the invention will only indicate to the operator of guns 32-1 to 32-5 that the gun from which coating materials is presently being dispensed, for example, gun 32-1, has become clogged to the extent that it no longer can provide adequate coating material flow. That typically means that it is no longer providing a sufficiently thick coating on an article 40 being coated. When the PLC 36 receives that indication, it acts as a triggering means and triggers that gun 32-1 out of service, and triggers another gun, for example, gun 32-2, through lines 33-1 and 33-2, respectively, to begin spraying. PLC 36 monitors the flow rate sensor 26-2 associated with gun 32-2 for the same conditions. In the meantime, maintenance can be called for the gun 32-1 which indicated clogging.

In the illustrated example, there are five guns 32-1 to 32-5 at the station 42 from which coating material is being applied to articles 40. Articles 40 illustratively are being conveyed along a conveyor 44 past station 42. Depending upon the needs of a particular installation, as few as two dispensing devices, for example, guns 32-1 to 32-2, or as many as five or more, may be desirable.

There typically will be intervals during which no article 40 to be coated is before station 42. During those intervals, typically in response to signals related to conveyor 44 motion, the PLC 36 disables all guns 32-1 to 32-5 from spraying, regardless of the flow rate signals being provided by their respective sensors 26-1 to 26-5.

Figure 2:
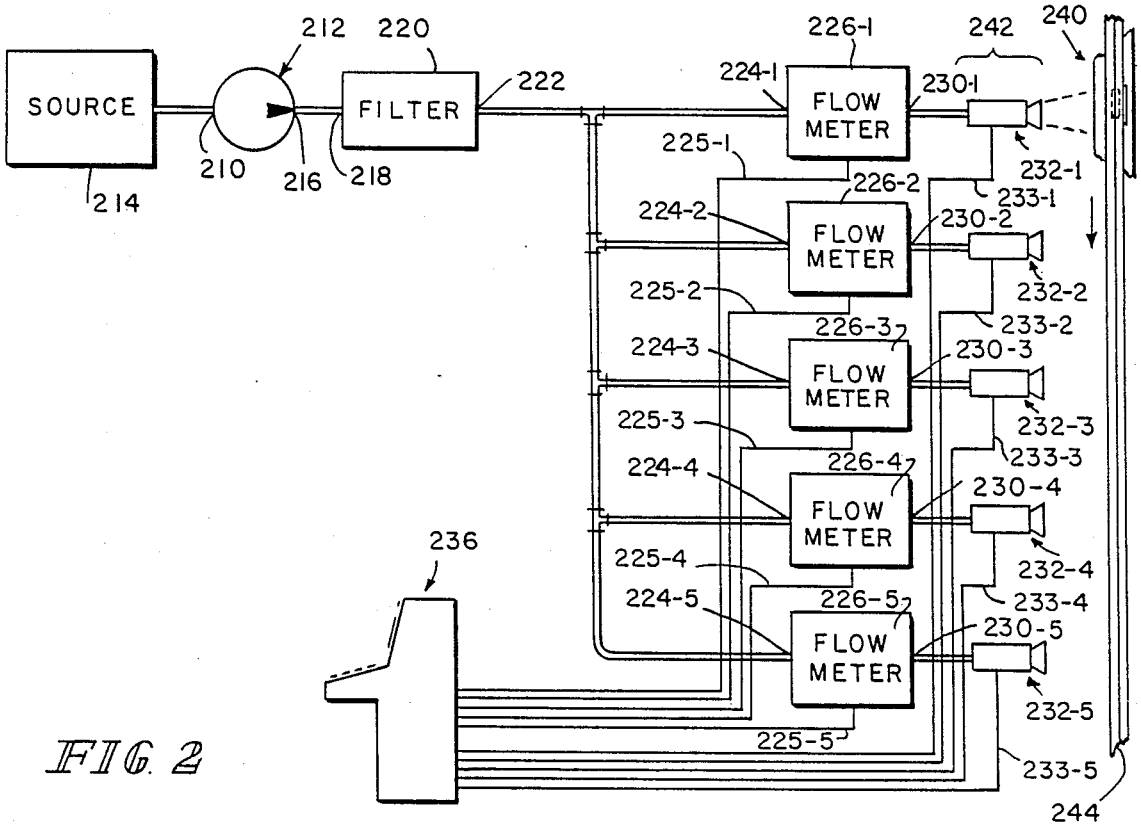
FIG. 2 illustrates a partly block and partly schematic diagram of another system constructed according to the invention for practicing the method of the invention.

Referring to FIG. 2, the input port 210 of a pump 212 is coupled to a source 214 of any suitable coating material. The output port 216 of pump 212 is coupled to the input port 218 of a suitable filter 220. The output port 222 of filter 220 is coupled to the input ports 224-1 to 224-5 of five identical fluid flow rate sensors 226-1 to 226-5. The output ports 230-1 to 230-5 of flow rate sensors 226-1 to 226-5, respectively, are coupled to the input ports of respective coating material dispensing devices 232-1 to 232-5. Devices 232-1 to 232-5 illustratively are Ransburg GEMA part number 73400-22 bell drives and 70571-01 bells. The electrical terminals of each flow rate sensor 226-1 to 226-5 are coupled by lines 225-1 to 225-5 to respective terminals of a programmable logic control station (PLC) 236 which provides power to the flow rate sensors 226-1 to 226-5, and senses the electrical output signals from sensors 226-1 to 226-5 which indicate the flow rates through the sensors 226-1 to 226-5 and their respective dispensing devices 232-1 to 232-5.

Only one of dispensing devices 232-1 to 232-5 will be dispensing coating material at any given time, so the station 236 in this embodiment of the invention will only indicate to the operator of dispensing devices 232-1 to 232-5 that the dispensing device from which coating materials is presently being dispensed, for example, dispensing device 232-1, has become clogged to the extent that it no longer can provide adequate coating material flow. That typically means that it is no longer providing a sufficiently thick coating on an article 240 being coated. When the PLC 236 receives that indication, it triggers that dispensing device 232-1 out of service through line 233-1, and triggers another dispensing device, for example, dispensing device 232-2, through line 233-2 to begin spraying. PLC 236 monitors the flow rate sensor 226-2 associated with dispensing device 232-2 for the same conditions. In the meantime, maintenance can be called for the dispensing device 232-1 which indicated clogging. In the illustrated example, there are five dispensing devices 232-1 to 232-5 at the station 242 from which coating material is being applied to articles 240. Articles 240 illustratively are being conveyed along a conveyor 244 past station 242. Depending upon the need of a particular installation, as few as two dispensing devices, for example, dispensing devices 232-1 to 232-2, or as many as five or more, may be desirable.

There typically will be intervals during which no article 240 to be coated is before station 242. During those intervals, typically in response to signals related to conveyor 244 motion, the PLC 236 disables all dispensing devices 232-1 to 232-5 from spraying, regardless of the flow rate signals being provided by their respective sensors 226-1 to 226-5.

Figure 3:
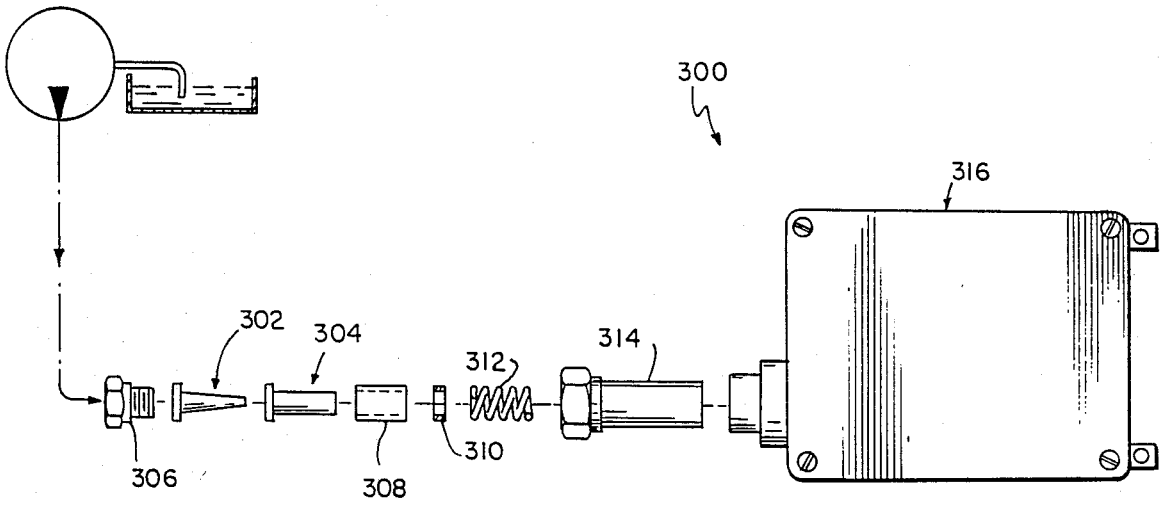
FIG. 3 illustrates a partly exploded side elevational view of a flow rate sensor constructed according to the present invention.

FIG. 3 illustrates a partially exploded side elevational view of a flow rate sensor 300 of the type employed as the flow rate sensor 26-1 to 26-5 in FIG. 1 and 226-1 to 226-5 in FIG. 2. Sensor 300 illustratively is a modified model 688-202 flow meter available from Hedland Division of Racine Federated, Inc., 2200 South Street, Racine, Wis. 53404, because it is the lowest flow rate capacity meter available from this source which has appropriate electronic interface capability. However, this flow meter has a two gallons per minute capacity. Because the components of the one gallon per minute capacity flow meter available from the same source are more sensitive to the lower flow rates required by the present application, the two gallon per minute components of the 688-202 meter are replaced by those of the one gallon per minute capacity meter. In addition, because of the typically abrasive nature of the coating materials which are used in the present application, the cone 302 and piston 304 of the flow meter 300 are further modified from the original equipment. Specifically in the flow meter of the present invention, cone 302 and piston 304 are fabricated from a highly abrasion resistant material such as, for example, type 303 stainless steel. The remaining components of flow meter 300, including cap 306, magnet 308, ring 310, spring 312 and cartridge body 314 are used as they come from the Hedland one gallon per minute capacity flow meter in the Hedland two gallon per minute capacity meter housing 316.

What is claimed is:

1. A method of coating articles with a coating material on a coating material application line having one or more coating material application stations, the method comprising the steps of providing at each coating station a plurality of coating material dispensing devices, only one of which is operative at any time from which devices coating material can be dispensed onto the articles, providing a source of coating material, coupling each of the devices to the source of coating material through a respective flow rate sensor for each dispensing device, triggering a first selected one of the dispensing devices to dispense coating materials onto an article, sensing the flow of coating material from the selected one of the dispensing devices with the flow rate sensor which couples the source to the first selected one of the dispensing devices, and triggering the first selected one of the dispensing devices to terminate dispensing of coating material and another selected one of the dispensing devices to dispense coating material when the flow rate sensor which couples the source to the first selected one of the dispensing devices senses a flow rate of coating material below a predetermined threshold to the first selected one of the dispensing devices.

2. The method of claim 1 wherein articles are to be coated during intervals during which coating material is to be dispensed from one of the dispensing devices and further comprising the step of inhibiting all of the dispensing devices from dispensing coating material except during said intervals.

3. Apparatus for coating articles with a coating material on a coating material application line, the apparatus comprising one or more coating material application stations, each station including a plurality of coating material dispensing devices for dispensing coating material, only one of which is operative at any time, a source of coating material, means for coupling each of the dispensing devices to the source of coating material, the coupling means including a flow rate sensor for each dispensing device, and means for triggering a first selected one of the dispensing devices to terminate dispensing of coating material and another selected one of the dispensing devices to dispense coating material, and means for coupling the flow rate sensors to the triggering means, whereby the flow rate sensor associated with the first selected one of the dispensing devices, upon sensing that the flow rate of coating material to the first dispensing device has dropped below a predetermined threshold, causes triggering of the first selected one of the dispensing devices to terminate dispensing of coating material, and triggering of another selected one of the dispensing devices to dispense coating material.

4. The apparatus of claim 3 wherein articles are to be coated during intervals during which coating material is to be dispensed from one of the dispensing devices and further comprising means for inhibiting all of the dispensing devices from dispensing coating material except during said intervals.

* * * * *